US007733358B2

(12) United States Patent
Hsu

(10) Patent No.: US 7,733,358 B2
(45) Date of Patent: Jun. 8, 2010

(54) LIQUID CRYSTAL DISPLAY AND DRIVING METHOD THEREOF

(75) Inventor: Ying-Hao Hsu, Tainan County (TW)

(73) Assignee: Chi Mei Optoelectronics Corp., Tainan County (TW)

( * ) Notice: Subject to any disclaimer, the term of this patent is extended or adjusted under 35 U.S.C. 154(b) by 1014 days.

(21) Appl. No.: 11/298,945

(22) Filed: Dec. 12, 2005

(65) Prior Publication Data

US 2006/0152469 A1 Jul. 13, 2006

(30) Foreign Application Priority Data

Dec. 13, 2004 (TW) ..... 93138544 A

(51) Int. Cl.
*G09G 3/36* (2006.01)

(52) U.S. Cl. ..... 345/693; 345/102

(58) Field of Classification Search ..... 345/82, 345/204, 420, 101, 693, 102
See application file for complete search history.

(56) References Cited

U.S. PATENT DOCUMENTS

| | | | | |
|---|---|---|---|---|
| 6,377,234 | B1 | 4/2002 | Nogawa | |
| 6,429,839 | B1 * | 8/2002 | Sakamoto | 345/87 |
| 6,577,775 | B1 * | 6/2003 | Li | 382/274 |
| 6,771,243 | B2 | 8/2004 | Hirohata | |
| 6,792,159 | B1 * | 9/2004 | Aufrichtig et al. | 382/260 |
| 7,050,609 | B2 * | 5/2006 | Huang | 382/124 |
| 7,058,238 | B2 * | 6/2006 | Lei | 382/280 |
| 7,375,719 | B2 * | 5/2008 | Oh et al. | 345/102 |
| 2004/0201564 | A1 * | 10/2004 | Sugino et al. | 345/101 |
| 2004/0257318 | A1 * | 12/2004 | Itoh | 345/87 |

FOREIGN PATENT DOCUMENTS

| | | | |
|---|---|---|---|
| CN | 1379388 | A | 11/2002 |
| TW | 499665 | B | 8/2002 |
| TW | 571274 | B | 1/2004 |
| WO | 0217289 | A1 | 2/2002 |

* cited by examiner

*Primary Examiner*—Amr Awad
*Assistant Examiner*—Tony Davis

(57) ABSTRACT

In a display device having a light source and a storage for storing at least one reference frame of image data, a driving method includes receiving a current frame of image data; comparing grey levels between pixels of the current frame of image data and the corresponding pixels of the reference frame of image data; determining a pixel quantity of pixels having different grey levels in the current frame of image data and the reference frame of image data; and based on the determined pixel quantity, calculating and outputting a signal controlling a light emitting duty ratio and an amplitude of the light source while displaying the current frame. The display device further has a comparing unit and light source control unit for performing the driving method.

20 Claims, 4 Drawing Sheets

LIQUID CRYSTAL DISPLAY AND DRIVING METHOD THEREOF

CROSS-REFERENCE TO RELATED APPLICATION

This application claims the priority benefit of Taiwan application No. 93138544 filed Dec. 13, 2004, the entirety of which is incorporated herein by reference.

TECHNICAL FIELD

The disclosure relates to a display device and a driving method thereof, and particularly, to a liquid crystal display (LCD) display and a driving method thereof.

BACKGROUND

Along with the coming of the information age, the demand for display devices as information presenting media continuously increases. Cathode ray tube (CRT) displays, having good display performance and being technologically mature, have dominated the display market for decades. However, recently developed high-tech products, such as LCDs, tend to be slimmer and better miniaturized. Therefore, LCDs with the advantages such as higher display quality, less space demand, lower power consumption and non-radiation technology gradually replace conventional CRT displays and become a mainstream in the display market.

Both of the foregoing two type displays have their advantages and disadvantages. A CRT display uses an electron beam in an impulse type driving to emit light. In other words, in a frame time (about 16.7 ms at 60 Hz refresh rate), the amplitude of a pixel brightness of the CRT display varies with time, so that the CRT display is adapted for displaying dynamic frames. However, when displaying static frames, such a CRT display is likely to cause flickering problems. Watching such flickering static frames for a long time may leave viewers' eyes uncomfortable.

As to LCD displays, most of them are driven to emit light in a hold type. In other words, in each frame time, the amplitude of backlight provided by a backlight source is constant. Therefore, LCD displays do not flicker when displaying static frames, which are more comfortable to viewers' eyes. However, such a backlight source when displaying dynamic frames causes problems of frame blurring due to the visual characteristics of human eyes.

In order to obtain better display performance, some LCD displays use impulse type backlight sources for displaying dynamic frames. Although such LCDs perform as good as CRT displays when displaying dynamic frames, unfortunately, they also suffer from CRT-like poor performance when displaying static frames.

SUMMARY

In accordance with an aspect, a driving method for driving a display device comprising a light source and a storage for storing at least one reference frame of image data, the driving method comprising: receiving a current frame of image data; comparing grey levels between pixels of the current frame of image data and the corresponding pixels of the reference frame of image data; determining a pixel quantity of pixels having different grey levels in the current frame of image data and the reference frame of image data; and based on the determined pixel quantity, calculating and outputting a signal controlling at least one of a light emitting duty ratio and an amplitude of the light source while displaying the current frame.

In accordance with a further aspect, a flat panel display comprises a display panel; a backlight source, disposed behind the display panel; and a data control circuit electrically connected to the display panel and the backlight source, the data control circuit comprising: a comparing unit for receiving and comparing a current frame of image data with a reference frame of image data; a frame image data storing unit electrically connected to the comparing unit for outputting the reference frame of image data stored therein to the comparing unit; and a light source control unit electrically connected to the backlight source and said comparing unit for controlling at least a driving parameter of the backlight source based on a comparison result received from said comparing unit.

Objects, features, and advantages of disclosed embodiments of the invention will become apparent from the following detailed description of such non-limiting embodiments. The following description is made with reference to the accompanying drawings.

BRIEF DESCRIPTION OF THE DRAWINGS

The disclosed embodiments of the invention, together with objects and advantages thereof, may be best understood by reference to the following description taken in conjunction with the accompanying drawings, in which like reference numerals identify like elements throughout and in which.

DETAILED DESCRIPTION OF EMBODIMENTS

Disclosed embodiments of the present invention now will be described with reference to the accompanying drawings. This invention can, however, be embodied in many different forms and should not be construed as limited to the embodiments set forth herein; rather, these embodiments are provided so that this disclosure will be thorough and complete, and will fully convey the scope of the invention to those skilled in the art.

In the disclosed embodiments, a backlight source of an LCD is driven, taking into account of a judgment whether the frame to be displayed is a static frame or a dynamic frame. An appropriate driving type will then be selected, thus improving the display quality of the LCD.

Figure 1:
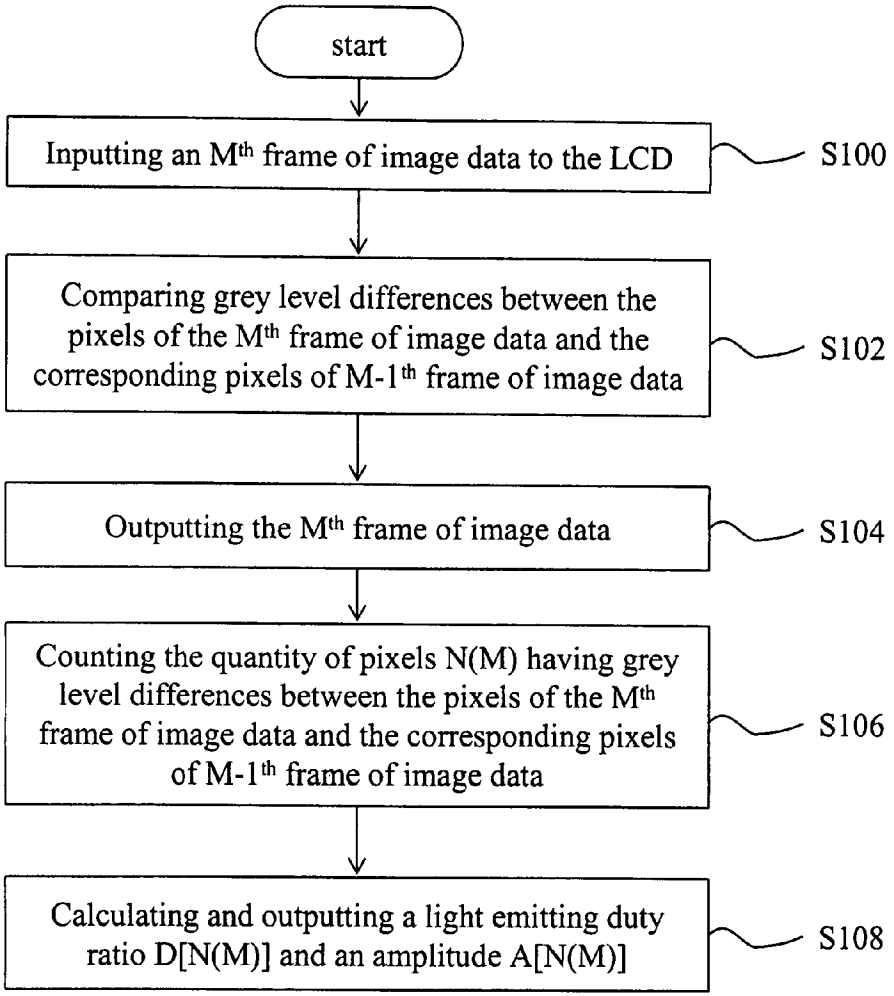
FIG. 1 is a flow chart illustrating a driving method according to a first embodiment of the invention.

An LCD according to an embodiment of the invention includes a display panel having I×J pixels, a backlight source and a data control circuit having at least one frame of image data stored therein. FIG. 1 is a flow chart illustrating a driving method according to a first embodiment of the invention.

Referring to FIG. 1, step S100 is processed first to input an $M^{th}$ frame of image data to the data control circuit which has stored therein a reference frame of image data, for example, an $M-1^{th}$ frame of image data. It is, however, within the scope of the present invention to store in the data control circuit, as a reference frame, any previous frame other than the $M-1^{th}$ frame. Then, step S102 is processed to compare grey levels of the pixels of the $M^{th}$ frame of image data and the corresponding pixels of the reference frame, e.g., $M-1^{th}$ frame of image data. Then, as shown in step S104, the $M^{th}$ frame of image data is outputted for displaying on the display panel of the LCD.

Thereafter, step S106 is processed to count the quantity of pixels N(M) having different grey levels in the $M^{th}$ frame of image data and the $M-1^{th}$ frame of image data. It is within the scope of the present invention to perform step S104 before, after, or simultaneously with any of steps S102 and S106. It is to be noted that in the disclosed embodiments of the present invention, a threshold grey level difference is set for avoiding incorrect counting results caused by noises. In an exemplary embodiment, a threshold grey level difference is set at 8 for an 8-bit (256 grey levels) image data to be processed. Nevertheless, the present invention does not restrict the threshold grey level difference to any particular value and it is within the scope of the present invention to select the threshold grey difference according to applications or practical requirements. According to the embodiment, a formula for calculating the pixel quantity N(M), for example, is:

$$N(M) = \sum_{i=1}^{I} \sum_{j=1}^{J} \{Z(M)(i, j)\} \tag{1}$$

where, when a grey level difference between a pixel (i,j) of the $M^{th}$ frame of image data and the corresponding pixel (i,j) of the $M-1^{th}$ frame of image data is equal to or greater than a threshold grey level difference, then Z(M)(i,j)=1; and when a grey level difference between the pixel (i,j) of the $M^{th}$ frame of image data and the corresponding pixel (i,j) of the $M-1^{th}$ frame of image data is less than the threshold grey level difference, then Z(M)(i,j)=0.

After the counting of the pixel quantity N(M) has been completed, step S108 is processed for calculating and outputting a signal controlling a light emitting duty ratio (or duty cycle) D and a light emitting amplitude A of the backlight source. According to the embodiment, the light emitting duty ratio D, for example, is a function, D[N(M)], of the pixel quantity N(M); and the light emitting amplitude A, for example, is also a function, A[N(M)], of the pixel quantity N(M). The light emitting duty ratio D is defined as:

$$D[N(M)] = \left[1 - \frac{N(M)}{N_{max}}(1 - D_{limit})\right], \tag{2}$$

where, $D_{limit}$ represents a threshold light emitting duty ratio of the backlight source, and $N_{max}$ represents a threshold pixel quantity.

It is to be noted that the brightness Y of light emitted from the backlight source is defined as a product of the light emitting duty ratio D[N(M)] and the light emitting amplitude A[N(M)], wherein the brightness Y is a constant, e.g., set by a user. Therefore, if the backlight source has a too small light emitting duty ratio D[N(M)], a relatively great light emitting amplitude A[N(M)] will be needed for holding the brightness Y constant. In order to provide display quality of dynamic frames at least as good as CRT displays, an appropriate threshold light emitting duty ratio $D_{limit}$ of the backlight source is set to prevent the light emitting duty ratio D from closing to 0 and having the light emitting amplitude A close to infinity. $D_{limit}$ sets the minimum value that D[N(M)] can have. In the embodiment, the threshold light emitting duty ratio $D_{limit}$ for example has a value of 25%. Again, the present invention does not restrict the light emitting duty ratio $D_{limit}$ to any particular value and it is within the scope of the present invention to select the light emitting duty ratio $D_{limit}$ according to applications or practical requirements.

The pixel quantity N(M) does not need to be equal to I×J, i.e., the whole current, i.e., $M^{th}$, frame, does not have to be completely different in grey level from the previous, i.e., $M-1^{th}$, frame, for the $M^{th}$ frame, to be considered as a dynamic frame. Due to specifics of human vision, a frame can be regarded as a dynamic one even when only a part of data of the frame is different from the correspond data of a previous frame. Therefore, an appropriate maximum threshold pixel quantity $N_{max}$ is set. If $N(M)>N_{max}$, the $M^{th}$ frame is "dynamic", otherwise it is "static". Herein, the embodiment set $N_{max}$ as 0.1×I×J, that is 10% of the resolution of the LCD. In other words, if $N(M)>N_{max}$, then 90% of the pixels of the display is considered "moved" and the $M^{th}$ frame is called "dynamic". Furthermore, according to the embodiment, if N(M) is greater than $N_{max}$, it is considered as being equal to $N_{max}$ in formula (2).

Figure 2A:
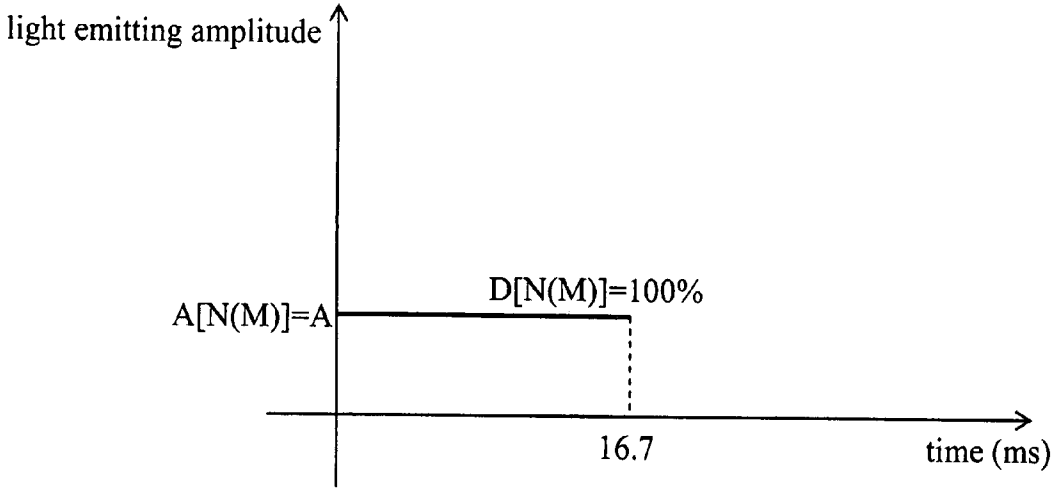
FIG. 2A is a diagram showing driving voltages of a backlight source displaying static frames according to an embodiment of the invention.

In a further embodiment, $N_{max}$ is set at zero. It follows from formulas (1) and (2) that, when the LCD display displays static frames, the possible grey level differences between the $M^{th}$ frame of image data and the corresponding pixels of the $M-1^{th}$ frame of image data are caused by noises only. Therefore, as shown in FIG. 2A, pixel quantity N(M) for a static frame as obtained by formula (1) is 0, while light emitting duty ratio D[N(M)] of the backlight source obtained by formula (2) is 1. In other words, when displaying static frames, the LCD according to the disclosed embodiment of drives the backlight source using a hold type driving method, so that flickering frames and, hence, viewer discomfort are avoided.

Figure 2B:
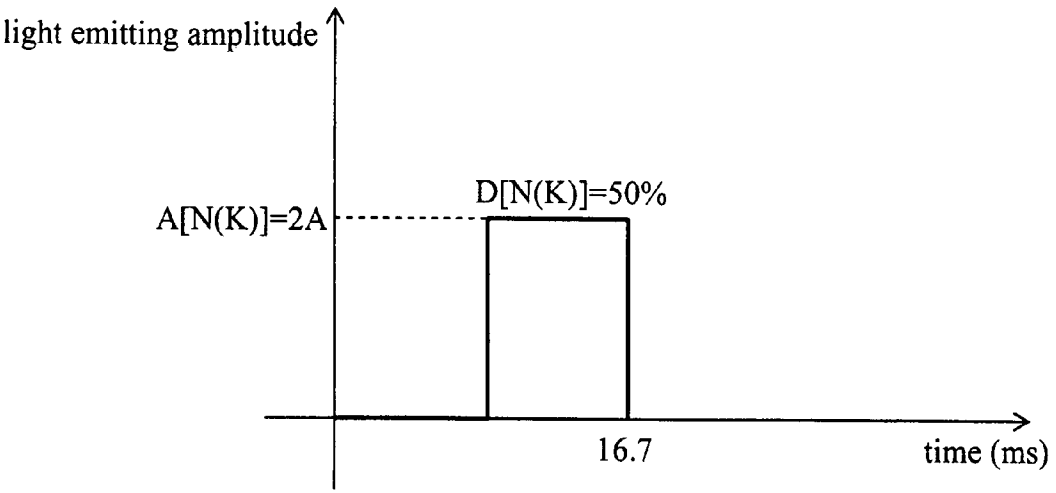
FIG. 2B is a diagram showing driving voltages of the backlight source displaying dynamic frames according to an embodiment of the invention.

As to displaying dynamic frames, the quantity of pixels being different in grey levels between the $M^{th}$ frame of image data and $M-1^{th}$ frame of image data can be obtained by formula (1). Thereafter, formula (2) is used to obtain the required light emitting duty ratio D[N(M)] of the backlight source. As shown in FIG. 2B, D[N(M)] is less than 1 for dynamic frames. In other words, the LCD of the disclosed embodiment drives the backlight source using an impulse type driving method to display dynamic frames clearer.

It is to be noted that the brightness Y of the backlight source is defined as a product of the light emitting duty ratio D[N(M)] and the light emitting amplitude A[N(M)], wherein the brightness Y of the backlight source is a constant. In other words, the product of the light emitting duty ratio and the light emitting amplitude in FIG. 2B is equal to the product of the light emitting duty ratio and the light emitting amplitude in FIG. 2A, that is, Y=D[N(M)]×A[[N(M)]=D[N(K)]×A[[N(K)], wherein M and K are positive integers, and M≠K. For example, as shown in FIG. 2A, the light emitting duty ratio D[N(M)] is 1, and the light emitting amplitude A[N(M)] is equal to A. Therefore, if the light emitting duty ratio D[N(K)] is, e.g., 50%, the light emitting amplitude A[N(K)] of FIG. 2B is equal to 2A. Thus, the brightness Y outputted by the backlight source can be determined in accordance with the invention.

Although in the foregoing embodiment, only the $M^{th}$ frame of image data and the $M-1^{th}$ frame of image data are illustrated to be compared at step S100, the scope of the invention is not limited to such. Another embodiment is provided below to further explain a further driving method in accordance with the present invention.

Figure 3:
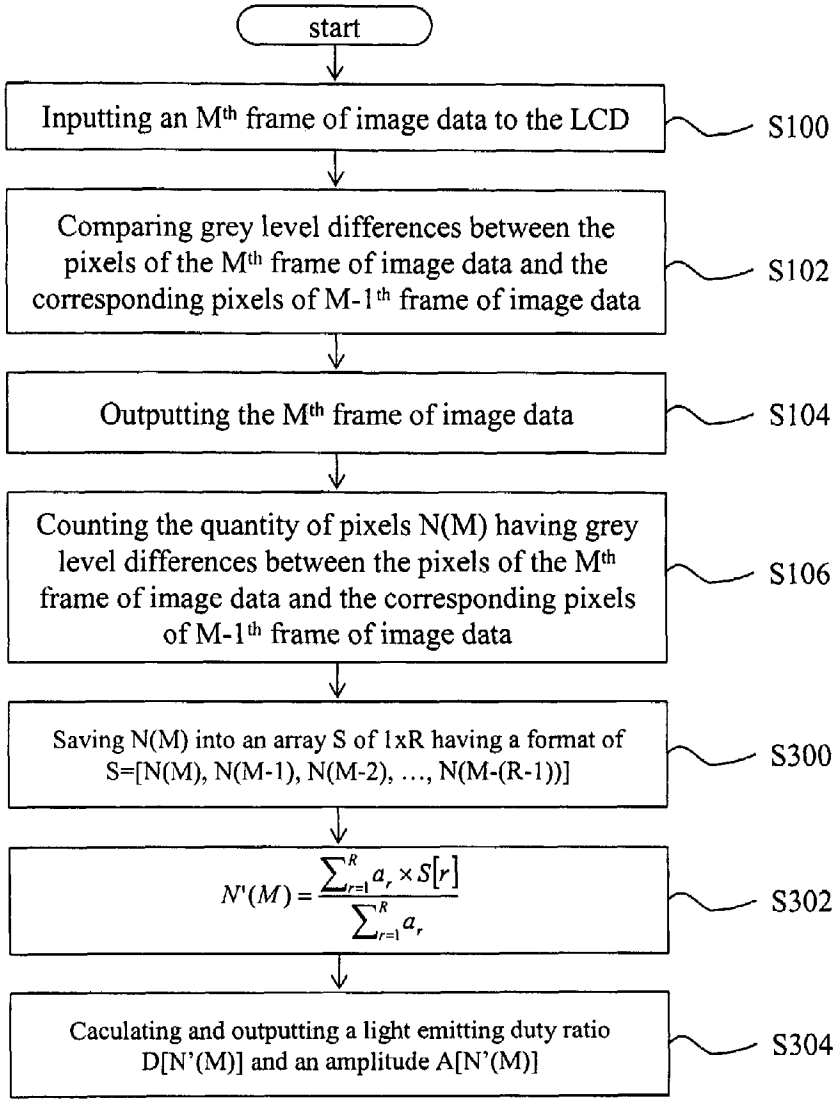
FIG. 3 is a flow chart illustrating a driving method according to a second embodiment of the invention.

FIG. 3 is a flow chart illustrating a driving method according to a further embodiment of the invention. According to the embodiment, the data control circuit of the LCD, for example, includes an array S of 1×R stored therein, the array S including elements S[1], S[2], S[3] . . . , S[R], wherein the initial values of all of the elements are 0, that is, S[1]=S[2]=S[3]= . . . S[R]. In other words, before the LCD is driven, S[1]=S[2]= . . . =S[R]=0.

The driving method illustrated in FIG. 3 includes steps S100 to S106 of the driving method illustrated in FIG. 1. Unlike the driving me illustrated in FIG. 1, after step S106, step S300 is processed to save the pixel quantity N(M) obtained in step S106 into the array S, wherein the array S has a format of S=[N(M), N(M−1), N(M−2) . . . , N(M−(R−1))]. In other words, step S300 is performed to save the pixel quantity N(M) associated with the $M^{th}$ frame as the element S[1] of the array S, to save the pixel quantity N(M−1) associated with the $M-1^{th}$ frame as the element S[2] of the array S etc., and finally to save the pixel quantity N(M−(R−1)) associated with the $M-(R-1)^{th}$ frame as the element S[R] of the array S.

Then, step S302 is performed to calculate an average pixel quantity according to the pixel quantities saved in the array S. A weighted average pixel quantity N'(M) is obtained by making a weighted calculation on the pixel quantities saved in the array S, the calculating formula being:

$$N'(M) = \frac{\sum_{r=1}^{R} a_r \times S[r]}{\sum_{r=1}^{R} a_r}, \tag{3}$$

where, $a_r$ is a weighted index number of the element S[r] of the array S and the weighted index number $a_r$, for example, is equal to or greater than $a_{r+1}$. In other words, the closer a previous frame is to the $M^{th}$ frame in timing sequence, the greater weight is given to the pixel quantity N associated with that previous frame. However, this arrangement of the values of the weighted index number $a_r$ should not be considered as a limitation to the scope of the invention, and other arrangements are not excluded.

Then, step S 304 is processed to calculate and output a light emitting duty ratio D and a light emitting amplitude A of the backlight source. The light emitting duty ratio D, for example, is a function D[N'(M)] of the weighted average pixel quantity N'(M), and, for example, is defined as:

$$D[N'(M)] = \left[1 - \frac{N'(M)}{N_{max}}(1 - D_{limit})\right], \tag{4}$$

where, the light emitting amplitude A for example is a function A[N'(M)] of the weighted average pixel quantity N'(M), and it is, for example, equal to a value of the brightness Y of the backlight source divided by the backlight source light emitting duty ratio D[N'(M)].

Formula (4) for calculating the backlight source light emitting duty ratio D[N'(M)] according to this embodiment is similar to formula (2) of the embodiment described with respect to FIG. 1, the most significant difference being that the pixel quantity N(M) associated with a single frame, i.e., the $M^{th}$ frame, is replaced with the weighted average of multiple pixel quantities associated with multiple frames from the $M-(R-1)^{th}$ frame to the $M^{th}$ frame.

Also, it follows from formulas (3) and (4) that, in this embodiment, appropriate different driving types can be selected for driving the backlight source when displaying either static frames or dynamic frames.

An LCD in which the driving methods according to the disclosed embodiments of the present invention can be performed will be described below without limiting the scope of the invention.

Figure 4:
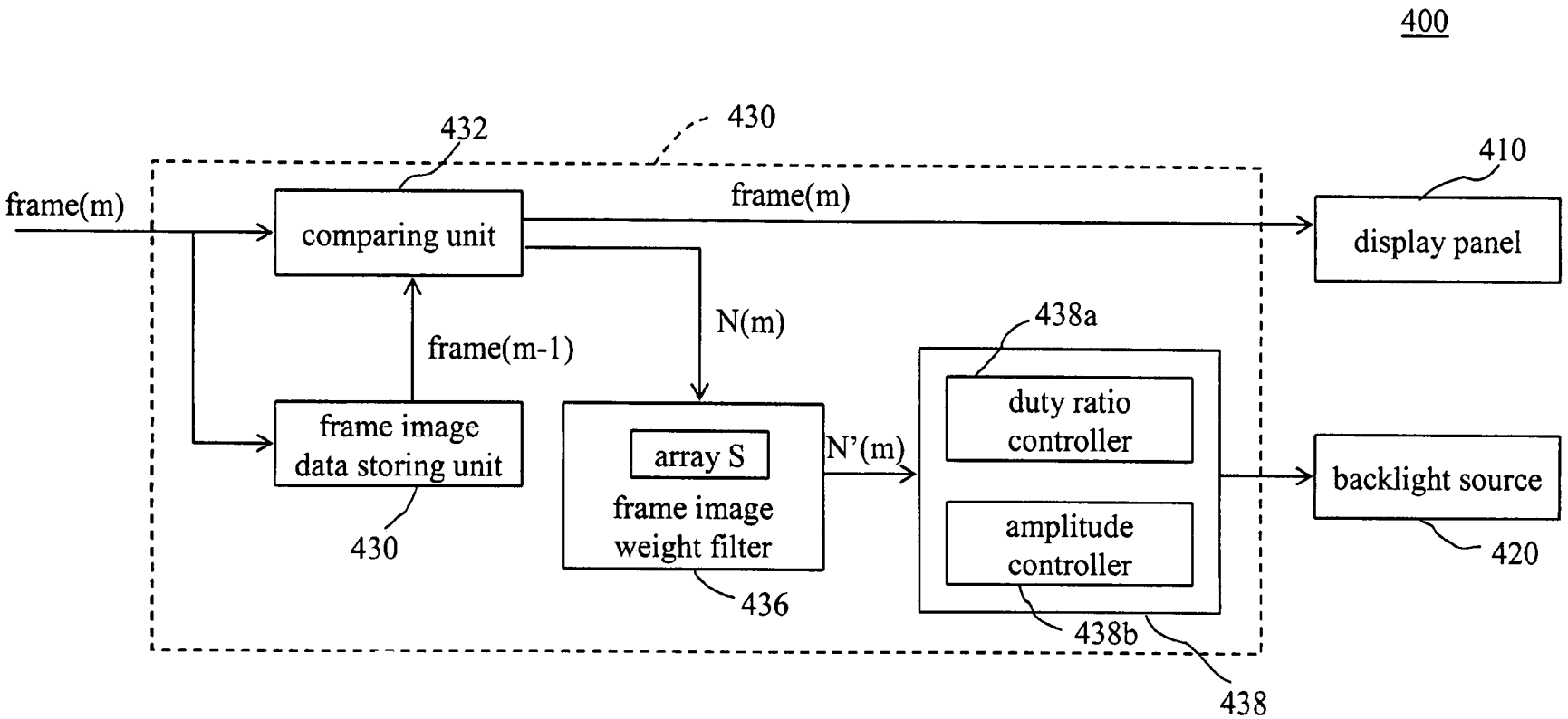
FIG. 4 is a block diagram illustrating an LCD according to an embodiment of the invention.

FIG. 4 is schematic block diagram illustrating an LCD according to an embodiment of the invention. Referring to FIG. 4, a flat panel display according to the embodiment of the invention, for example, is an LCD 400. The LCD 400 includes a display panel 410, a backlight source 420 and a data control circuit 430. The backlight source 420 is disposed under the display panel 410 for providing backlight to the display panel 410. The data control circuit 430 is electrically connected to the display panel 410 and the backlight source 420, and is generally includes a comparing unit 432, a frame image data storing unit 434 and a light source control unit 438.

The comparing unit 432 is configured to receive an $M-1^{th}$ frame of image data (frame M−1) from the frame image data storing unit 434, compare the pixel grey levels between the stored $M-1^{th}$ frame of image data (frame M−1) and the inputted $M^{th}$ frame of image data (frame M), and then output the $M^{th}$ frame of image data (frame M) to the display panel 410. The $M-1^{th}$ frame of image data (frame M−1), for example, is stored in the frame image data storing unit 434 which is electrically connected to the comparing unit 432. When the $M^{th}$ frame of image data (frame M) is inputted (step S100 of FIG. 1) into the comparing unit 432, it is also inputted into the frame image data storing unit 434 and saved therein for being compared with the next frame, i.e., the $M+1^{th}$ frame of image data (frame M+1). The comparison result N(M) can be directly outputted (not shown in FIG. 4) to the light source control unit 438 for calculation of the light emitting duty ration D and amplitude A. This structure of the data control circuit 430, with components 432, 434 and 438, is sufficient to perform the driving method described with respect to FIG. 1.

In order to perform the driving method described with respect to FIG. 3 using more previous frames of image data, the data control circuit 430 further includes a frame image weight filter 436. The frame image weight filter 436 is electrically connected to the comparing unit 432 for receiving a plurality of comparison results outputted from the comparing unit 432. The frame image weight filter 436 further includes an array S of 1×R stored therein. The array S includes elements S[1], S[2], S[3] . . . , S[R], and the initial values of all of the elements are 0, that is, S[1]=S[2]=S[3]= . . . S[R]=0, as disclosed above. The pixel quantities the frame image weight filter 436 received from the comparing unit 432 are to be saved in the array S, wherein the array S has a format of S=[N(M), N(M−1), N(M−2) . . . , N(M−(R−1))], as disclosed above. The comparison results are used by frame image weight filter 436 to calculate a weighted distribution, e.g., the weighted average pixel quantity N'(M), as disclosed above. The weighted distribution N'(M) is then outputted to the light source control unit 438. The light source control unit 438, for example, includes a backlight source duty ratio controller 438*a* and a backlight source amplitude controller 438*b*.

After receiving the calculating result, i.e., N'(M), from the frame image weight filter 436 and determining the required backlight source duty ratio D and amplitude D, the light source control unit 438 outputs appropriate driving voltages or currents to drive the backlight source 420 according to the obtained values D and A. Therefore, the LCD 400 displays images according to the frames of image data inputted to the display panel 410. The light emitting duty ratio D of the backlight source 420 is controlled by the backlight source duty controller 438*a*, and the light emitting amplitude A is controlled by the backlight source amplitude controller 438*b*. The backlight source duty controller 438*a* and the backlight source amplitude controller 438*b* maintain the products of the light emitting duty ratio D and the light emitting amplitude A of different frames constant and thus maintaining the brightness of the backlight source unchanged, unless adjusted by a user.

The disclosed embodiments of the present invention provide a driving method which selects appropriate driving types according to the frame status. The disclosed embodiments of the present invention further provide an LCD display configured to provide optimized display quality when displaying both dynamic and static frames. According to the disclosed embodiments of the invention, a frame of image data is first inputted into the LCD, then the grey levels between the pixels of the present frame of image data and the pixels of at least a previous frame of image data are compared for counting the pixel quantities N(M) according to which the dynamic or static status of the present frame is judged. The counting result is used for determining the backlight source duty ratio.

For example, when $N_{max}=0$ and the counting result is not 0, the present frame is considered as a dynamic frame; accordingly, the backlight source will be driven in an impulse type (for example, as shown in FIG. 2B) for displaying the present, dynamic frame clearly. Otherwise, i.e., when the counting result is 0, the frame is considered as a static frame; accordingly, the backlight source will be driven in a hold type (for example, as shown in FIG. 2A) for avoiding flickering.

In summary, the disclosed embodiments of the present invention selectively use an appropriate driving type, e.g., an impulse type or a hold type, for driving the LCD according to a determination whether the frames to be displayed are dynamic or static. In other words, an LCD being driven with the driving method according to the disclosed embodiments of the invention takes advantage of multiple driving types, e.g., both the impulse type and the hold type, without the disadvantages associated with the driving types. Thus, the LCD provides consistent optimized display quality regardless of whether the frames being displayed are static or dynamic.

While the invention has been described by way of example and in terms of the disclosed embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A driving method for driving a display device comprising a light source and a storage for storing at least one reference frame of image data, the driving method comprising: receiving a current frame of image data; comparing grey levels between pixels of the current frame of image data and the corresponding pixels of the at least one reference frame of image data; determining a pixel quantity of pixels having different grey levels in the current frame of image data and the reference frame of image data; and based on the determined pixel quantity, calculating and outputting a signal controlling a light emitting duty ratio and an amplitude of the light source while displaying the current frame; wherein the display device further comprises an array S of 1×R, and after the step of determining the pixel quantity N(M) associated with the current frame of image data which is a $M^{th}$ frame, the driving method further comprises, saving the determined pixel quantity N(M) in the array S, wherein the array S has a format of S=[N(M), N(M−1), N(M−2) . . . , N(M−(R−1))], and R represents the quantity of the at least one reference frame; and wherein the pixel quantity N(M) associated with the current frame of image data, which is a $M^{th}$ frame having I×J pixels, is determined as $$N(M)=\sum_{i=1}^{I}\sum_{j=1}^{J}\{Z(M)(i,\ j)\},$$

where, when a difference between a pixel (i,j) of the $M^{th}$ frame of image data and the corresponding pixel (i,j) of the reference frame of image data is equal to or greater than a threshold grey level difference, then Z(M)(i,j)=1, and when the difference between the pixel (i,j) of the M frame of image data and the corresponding pixel (i,j) of the reference frame of image data is less than said threshold grey level difference, then Z(M)(i,j)=0.

2. The driving method according to claim 1, wherein the threshold grey level difference is equal to or greater than 2.

3. The driving method according to claim 1, wherein the light emitting duty ratio D is a function, D[N(M)], of the pixel quantity N(M), and the amplitude A of the light source is a function, A[N(M)], of the pixel quantity N(M).

4. The driving method according to claim 1, wherein before the step of calculating and outputting the signal controlling the light emitting duty ratio D and amplitude A of the light source, the driving method further comprises calculating an average pixel quantity based on the array S.

5. The driving method according to claim 4, wherein the average pixel quantity is calculated as a weighted average pixel quantity N'(M), N'(M) being calculated as:

$$N'(M)=\frac{\sum_{r=1}^{R}a_r\times S[r]}{\sum_{r=1}^{R}a_r},$$

wherein, S[r] is an $r^{th}$ element of the array S, r=1, 2, . . . , or R; and $a_r$ is a weighted index number of the element S[r] of the array S, the light emitting duty ratio D is a function D[N'(M)] of the weighted average pixel quantity N'(M), and the amplitude A is a function A[N'(M)] of the weighted average pixel quantity N' (M).

6. The driving method according to claim 5, wherein the weighted index number $a_r$ of the element S[r] of the away S satisfies $a_r \geqq a_{r+1} \geqq 0$.

7. The driving method according to claim 5, wherein the light emitting duty ratio D of the light source is defined as:

$$D[N'(M)]=\left[1-\frac{N'(M)}{N_{max}}(1-D_{limit})\right],$$

wherein, $D_{limit}$ represents a threshold light emitting duty ratio of the light source, and $N_{max}$ represents a threshold pixel quantity.

8. The driving method according to claim 7, wherein the threshold pixel quantity $N_{max}$ is equal to or less than 10% of the pixel resolution of the display device.

9. The driving method according to claim 7, the threshold duty of the light source $D_{limit}$ is equal to or greater than 25%.

10. The driving method according to claim 1, wherein the reference frame is a previous frame of the image data and wherein the previous frame precedes the current frame.

11. The driving method according to claim 10, wherein the previous frame and the current frame are successive frames of the image data.

12. A driving method for driving a display device comprising a light source and a storage for storing at least one reference frame of image data, the driving method comprising: receiving a current frame of image data; comparing grey levels between pixels of the current frame of image data and the corresponding pixels of the at least one reference frame of image data; determining a pixel quantity of pixels having different grey levels in the current frame of image data and the reference frame of image data; and based on the determined pixel quantity, calculating and outputting a signal controlling a light emitting duty ratio and an amplitude of the light source while displaying the current frame; wherein the display device further comprises an array S of 1×R, and after the step of determining the pixel quantity N(M) associated with the current frame of image data which is a Mth frame, the driving method further comprises, saving the determined pixel quantity N(M) in the array S, wherein the array S has a format of S=[N(M), N(M−1), N(M−2) . . . N(M−(R−1))], and R represents the quantity of the at least one reference frame; wherein the light emitting duty ratio D is a function, D[N(M)], of the pixel quantity N(M), and the amplitude A of the light source is a function. A[N(M)], of the pixel quantity N(M); and wherein the light emitting duty ratio D is defined as:

$$D[N(M)] = \left[1 - \frac{N(M)}{N_{max}}(1 - D_{limit})\right],$$

wherein, $D_{limit}$ represents a threshold light emitting duty ratio of the light source, and $N_{max}$ represents a threshold pixel quantity.

13. The driving method according to claim 12, wherein if the pixel quantity [N(M)] is greater than the threshold pixel quantity $N_{max}$, then the pixel quantity [N(M)] will be equal to the threshold pixel quantity $N_{max}$.

14. The driving method according to claim 12, wherein the threshold duty of the backlight source $D_{limit}$ is equal to or greater than 25%.

15. The driving method according to claim 12, wherein the threshold pixel quantity $N_{max}$ is equal to or less than 10% of the pixel resolution of the display device.

16. A flat panel display, comprising:

a display panel;

a backlight source, disposed behind the display panel; and a data control circuit electrically connected to the display panel and the backlight source, the data control circuit comprising:

an input for receiving image data to be displayed on the display panel, said image data comprising a current frame and a previous frame preceding the current frame;

a comparing unit electrically connected to the input for receiving the current frame and for comparing the current frame of the image data with the previous frame of the image data;

a frame image data storing unit electrically connected to the input for receiving and storing the previous frame, and electrically connected to the comparing unit for outputting the previous frame of the image data stored in the frame image data storing unit to the comparing unit; and a light source control unit electrically connected to the backlight source and said comparing unit for controlling, based on a comparison result received from said comparing unit, at least a driving parameter of the backlight source to provide controlled backlight to the display panel for displaying the current frame on the display panel;

wherein the light source control unit further comprises a backlight source duty ratio controller and a backlight source amplitude controller, wherein a light emitting duty ratio of the backlight source is controlled by the backlight source duty ratio controller, and a light emitting amplitude of the backlight source is controlled by the backlight source amplitude controller, wherein the light emitting duty ratio D is a function, D[N(M)], of the pixel quantity N(M), and the amplitude A of the light source is a function, A[N(M)], of the pixel quantity N(M), wherein the light emitting duty ratio D is defined as:

$$D[N(M)] = \left[1 - \frac{N(M)}{N_{max}}(1 - D_{limit})\right],$$

and wherein, $D_{limit}$ represents a threshold light emitting duty ratio of the light source, and $N_{max}$ represents a threshold pixel quantity.

17. The flat panel display according to claim 16, wherein the data control circuit further comprises a frame image weight filter electrically connected between the light source control unit and the comparing unit for receiving and storing comparison results previously outputted from the comparing unit, calculating a weighted distribution of the comparison results, and outputting the calculated weighted distribution to the light source control unit to cause said light source control unit to control said driving parameter based on the calculated weighted distribution.

18. The flat panel display according to claims 16, wherein the flat panel display is an LCD.

19. A driving method for driving a display device comprising a light source and a storage for storing at least one reference frame of image data, the driving method comprising:

receiving a current frame of image data;

comparing grey levels between pixels of the current frame of image data and the corresponding pixels of the at least one reference frame of image data;

determining a pixel quantity of pixels having different grey levels in the current frame of image data and the reference frame of image data; and based on the determined pixel quantity, calculating and outputting a signal controlling a light emitting duty ratio and an amplitude of the light source while displaying the current frame;

wherein the light emitting duty ratio D is a function, D[N(M)], of the pixel quantity N(M), and the amplitude A of the light source is a function, A[N(M)], of the pixel quantity N(M), wherein the light emitting duty ratio D is defined as:

$$D[N(M)] = \left[1 - \frac{N(M)}{N_{max}}(1 - D_{limit})\right],$$

and wherein, $D_{limit}$ represents a threshold light emitting duty ratio of the light source, and $N_{max}$ represents a threshold pixel quantity.

20. The driving method according to claim 19, further comprising:

determining whether the current frame is a dynamic frame or a static frame;

sending a hold type driving signal to the backlight source when the current frame is a static frame; and sending an impulse type driving signal to the backlight source when the current frame is a dynamic frame.

* * * * *